United States Patent [19]

Basgil et al.

[11] Patent Number: 4,853,063

[45] Date of Patent: Aug. 1, 1989

[54] SYSTEM FOR APPLYING OUTSERTS TO CONTAINERS

[75] Inventors: David E. Basgil, Edgewater Park; Mark K. Shuster, Indian Mills; Thomas R. Pituch, Medford, all of N.J.

[73] Assignee: Alford Industries, Inc.

[21] Appl. No.: 207,785

[22] Filed: Jun. 17, 1988

[51] Int. Cl.[4] ..... B65C 9/10; B65C 9/14

[52] U.S. Cl. ..... 156/238; 156/249; 156/285; 156/361; 156/364; 156/494; 156/495; 156/497; 156/542; 156/564; 156/572; 156/573; 156/DIG. 29; 156/DIG. 31; 271/31.1; 271/33; 271/102; 226/96

[58] Field of Search ..... 156/564, 573, 566, 541, 156/542, 570, 572, 497, 494, 238, DIG. 31, 285, 361, 249, 364, 495, DIG. 29; 271/33, 31.1, 101, 102, 169; 226/95, 96; 414/128; 350/531

[56] References Cited

U.S. PATENT DOCUMENTS 4,248,498 2/1981 Georges ..... 350/531
4,502,910 3/1985 Voltmer et al. ..... 156/361
4,555,299 11/1985 Voltmer et al. ..... 156/552
4,610,753 9/1986 Voltmer et al. ..... 156/552

*Primary Examiner*—Michael W. Ball
*Assistant Examiner*—Michele K. Yoder

[57] ABSTRACT

A system for applying folded outserts to conveyed products utilizing a pressure sensitive tape for transportation from the magazine type hopper to the products. The tape with a pressure sensitive adhesive is routed in front of the outfeed of the outsert hopper. A reciprocating tape tamping device and vacuum manifold mounted on an air cylinder are used to first bump the adhesive-coated tape in contact with the outsert and then withdraw the outsert from the hopper. The withdrawal occurs after the initial precise placement of the outsert to the tape. The method of withdrawal requires further forward movement of a pair of bellow style cups which contact the outsert after adhesion. The initiation of vacuum on contact and termination on withdrawal permit the outsert to be retained individually on the tape. The outsert is then indexed forward where it is transferred to a conveyed product.

15 Claims, 6 Drawing Sheets

SYSTEM FOR APPLYING OUTSERTS TO CONTAINERS

BACKGROUND OF THE INVENTION

1. Field of the Invention

The present invention relates to packaging equipment and, more specifically, to a system for applying literature, such as folded matter, to the outside of a container.

2. Description of the Related Art

Containers used in the marketplace often must be accompanied by more information than can be given on the label. Information as to the contents of the container, such as the proper administration of required doses or the effects of longterm use of the content, is therefore often placed on a folded miniature packet known as an outsert. The outsert is, by definition, secured onto the outside of the container.

Unfortunately, there is no known commercially available equipment which can readily convert a standard labeling machine head into an outsert applying system. Outsert applying machines and labeling machine heads are both available individually, but no single head exists that can accomplish both of these applications.

Furthermore, the known outsert applying machines have a number of problems. Web breaks are a constant problem. Tension of the web is critical because too much tension causes web breaks, while not enough tension will cause the web to sag. For an unwind assembly to operate with proper tension, the web ordinarily must be sent around an idle roller before it goes to a dancer arm. The unwind roller and the dancer arm work in unison and are connected together by a belt fastened to an eccentric cam at the base. As the web pulls the dancer arm down, tension of the belt of the unwind roller is relieved, allowing the unwind roller to spin in a manner that lets the web feed. After the web feeds, the dancer arm is swung back to its original position by an extension spring connected to its arm and the base of the machine. When it returns, the belt tightens up around the unwind roller, acting as a brake, and thus preventing unraveling of the tape. However, it is impossible to utilize the above type of slack take-up mechanism in the present invention because one side of the web is coated with an adhesive.

In order to use adhesive-coated webs in outsert applying machines, other companies may use expensive selfmotorized, electro-mechanical mechanisms to maintain constant tension as the web feeds through the system.

Removing the outsert from a magazine hopper and placing it on the web consistently is another requirement. Other companies may use a reciprocating or rotary mechanism that takes the outsert out of a hopper using a vacuum, turns the outsert at an angle of 90° with respect to the web, and then releases the vacuum, thus adhering the outsert to the web. However, this type of mechanism does not apply the outsert to the web with consistent accuracy, and must be rebuilt frequently due to constant mechanical wear.

Another problem is unwanted adhesive buildup on the drive roller of the outsert applying machine. Ordinarily, outserts are spaced about 1/16" apart on the web. After the outsert is removed from the web and applied to a container, a small amount of an adhesive remains on the web until it comes in contact with the drive roller. Build-up of adhesive on the drive roller causes machine stoppage due to clean up.

Outserts may also be applied to containers using glue machines. The outserts are removed from a hopper and placed on a rotary drum. The drum holds the outserts by vacuum and is rotated to a station that applies glue to the back of the outsert. The drum is then rotated to another station where the outsert is applied directly onto a container. This method of applying an outsert to the container, however, is messy and inaccurate.

SUMMARY OF THE INVENTION

Accordingly, the objective of the invention is to provide an outsert applicator mechanism which is mechanically simple, provides accurate placement of the outsert to the adhesive tape, is positive in placement, minimizes web breaks, is retrofittable to a standard pressure sensitive label applicator, collects adhesive residue and provides accurate placement of the outsert to the product.

The invention achieves the foregoing objectives by a unique combination of features. In order to maintain a constant tension on the web, the invention has a vacuum roller which spins in the opposite direction as the web. As counter rotation occurs, vacuum pulls the backside of the non-adhesive side of the web.

This is achieved by pulling vacuum through the shaft that holds the roller and making a cutout in the shaft where the web will be. Holes are disposed all around the roller, but only the section that spins by an orifice in the shaft will have vacuum on it. Any slack that may occur in the web when the web is deflected into the outsert hopper (discussed later) is immediately taken back by this roller spinning in the opposite direction of web travel and pulling on the web with vacuum.

To apply the outsert to the web, the invention utilizes a vacuum manifold and an adjustable bumper mounted on an inexpensive air cylinder. The bumper pushes the web into the outsert, rather than vice versa, thus allowing accurate placement of the outsert on the web with few moving mechanical parts. To avoid adhesive built up on the drive roller, the invention employs a spring loaded roller which rides with the web and collects excess adhesive before the web reaches the drive roller.

DETAILED DESCRIPTION OF THE INVENTION

Figure 1:
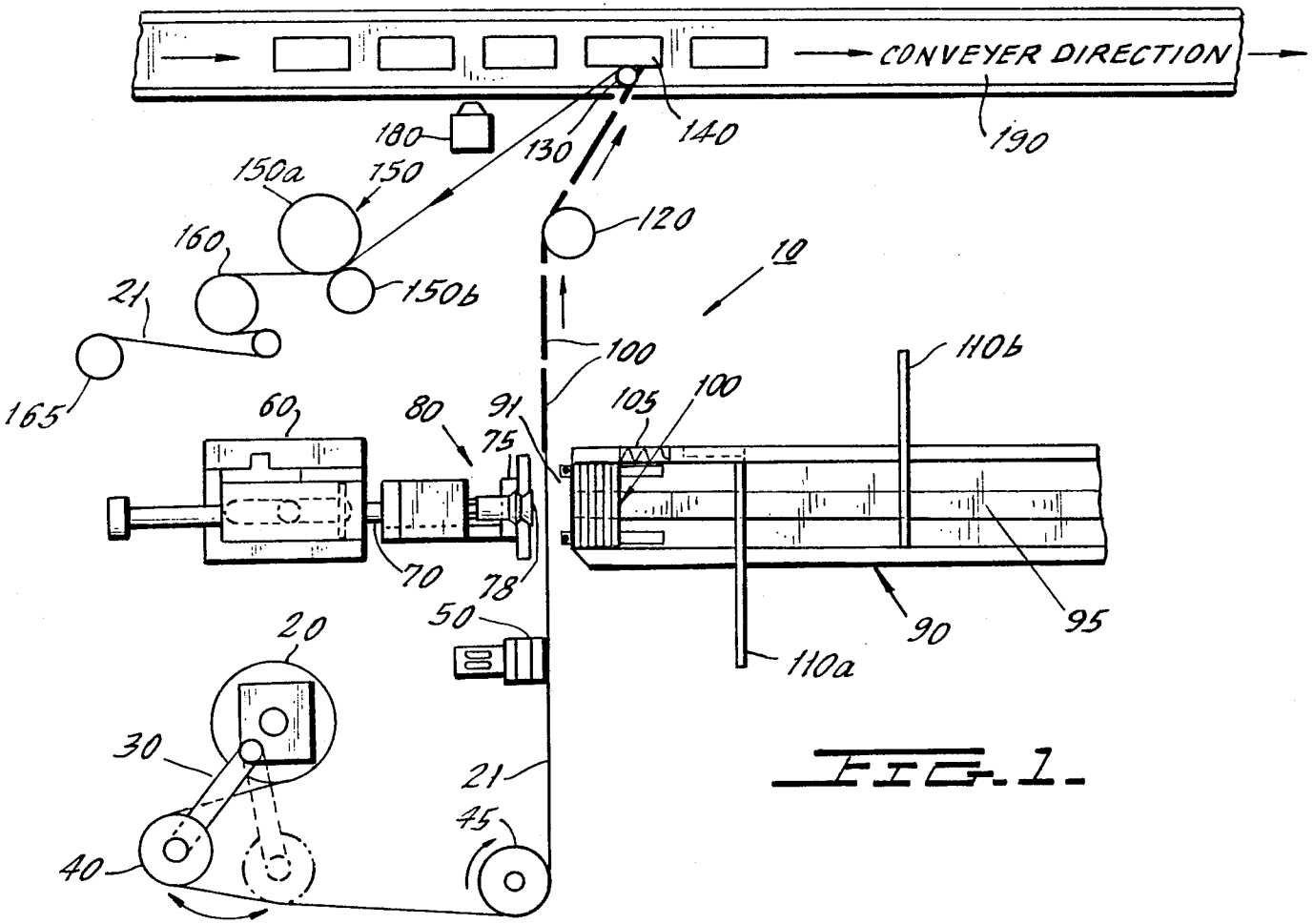
FIG. 1 illustrates and top view of the outsert applying system.
Figure 2:
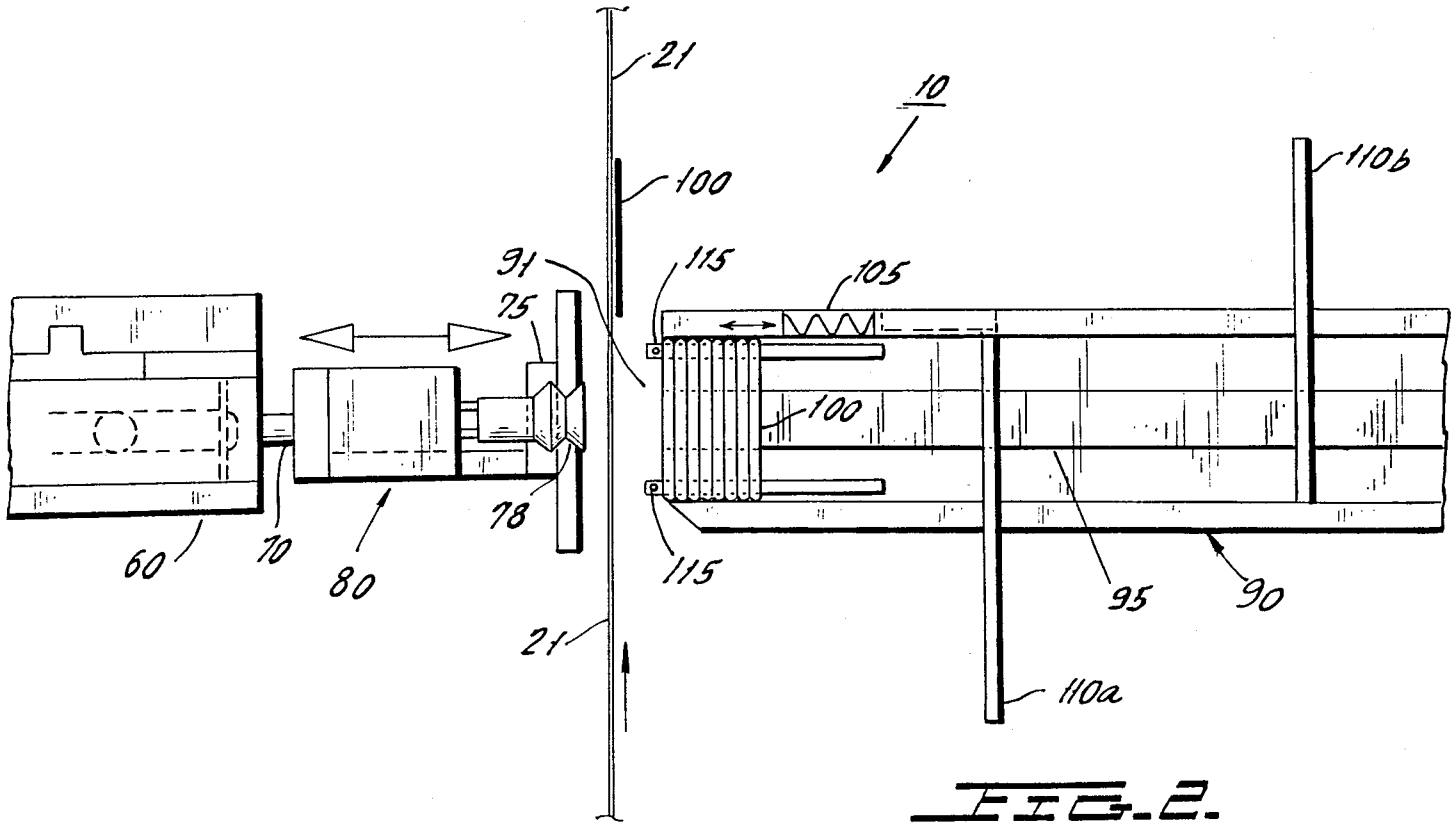
FIGS. 2–6 illustrate one cycle of interaction of the bumper assembly and outsert hopper of the present invention.
Figure 3:
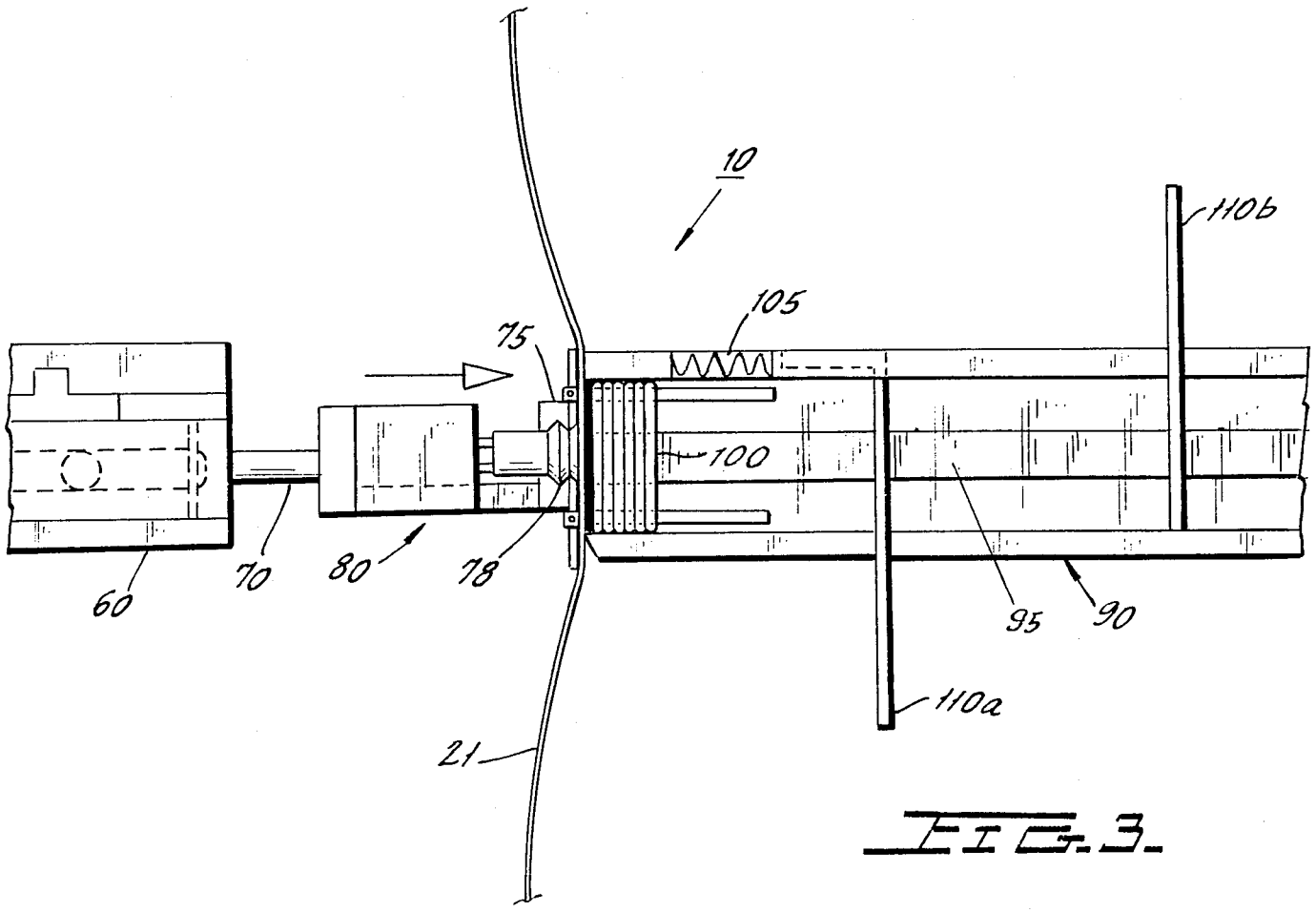

Referring to FIG. 1, the apparatus of the present invention for applying outserts to containers is identified generally by reference numeral 10. Apparatus 10 utilizes an adhesive transfer tape web 21 which is fed from a supply roller 20. Adhesive transfer tape web 21 is coated with adhesive on only one surface.

Dancer arm 30 and stationary roller 40 are employed at the unwind to maintain constant tension on adhesive web 21. Dancer arm 30 pivots about an arc in response to web tension. When the web stops feeding in, dancer 30 pivots to the left as shown by the arrow in FIG. 1. When web tension in apparatus 10 increases, dancer arm 30 pivots toward the position shown in hatched lines.

After passing around the stationary roller 40, web 21 travels around another roller 45 which is driven and constantly spins in the opposite direction of web travel. Roller 45 also has holes in it through which a vacuum can be applied to the backside of the web. Roller 45 spins but vacuum remains on only the portion of the roller that has tape on it. This is achieved by sending vacuum thru the shaft that holds the roller and making a cutout in the shaft where the web will be. Holes are disposed all around the roller, but only the section that spins by an orifice in the shaft will have vacuum on it. Any slack that may occur in the web when the web is deflected into the outsert hopper (discussed later) is immediately taken back by this roller 45 spinning in the opposite direction of web travel and pulling on the web 21 with vacuum. A vacuum manifold 50 is also situated directly before the hopper 90. In this manner, constant tension is achieved, but not so much as would cause the web to tear.

Movement of web 21 through the outsert applying system 10 is controlled by the drive roller 160. Web 21 is moved incrementally after each cycle outsert application, as discussed in further detail below. The cycle is initiated when sensor 180 detects the presence of container 140 within its view. Container 140 moves along a product conveyor belt 190 at a predetermined speed and predetermined pitch. When sensor 180 detects a container, it relays information to a clutch that turns drive roller 160. The adhesive tape web 21 continues to be advanced by the drive mechanism until it feeds the length of one outsert. This is achieved by placing an encoder (not shown) on the gearbox that drives the conveyor. The width of the outsert is programmed into a counter. For each revolution an encoder spins, it emits a certain amount of electric pulses. Enough pulses to make the drive roller feed the width of one outsert is programmed into a counter. After sensor 180 detects the presence of container 140, the clutch is initiated. The drive roller starts to spin and the encoder emits pulses to the counter. When the counter counts the number of pulses it was programmed to look for, it initiates the brake that stops the drive roller.

In accordance with the invention, outserts are accurately and easily applied to adhesive web tape 21 by a bumper and vacuum assembly 80. Assembly 80 is mounted on a piston 70 and is moved by an air-actuated cylinder mechanism 60. Shaft 70 moves from a retracted position (as shown in FIG. 1) to an extended position where the bumper 75 displaces the web into contact with an outsert at an outlet 91 of an outsert hopper 90. The side of web 21 contacting the outsert contains the adhesive, which causes outsert 100 to stick to the web 21.

As can be better seen in the top views of FIGS. 2–6, assembly 80 moves through a repetitive cycle starting in an initial retracted position wherein assembly 80 is located away from web 21, and web 21 is positioned in front of an outsert hopper 90. Air cylinder 60 is then activated, moving assembly 80 to an extended position illustrated in FIG. 3, in which bumper 75 displaces adhesive web 21 from its original position to a position where it contacts an outsert 100 at outlet 91 of outsert hopper 90. The bumper has a width of approximately three outserts, since this method provides a more gentle push on the web than if it was the width of only one outsert.

The outfeed portion of the hopper has a spring loaded side guide 105, the outserts being retained in hopper 90 by pins 115 which hang overhead and protrude up from the bottom of the hopper. When bumper 75 pushes web 21 into an outsert 100, it goes about an $\frac{1}{8}$ inch into the hopper 90. By spring loading the side guide, the outsert that was previously applied to the web will not be bent by the bumper pushing into the guide. This also helps to insure that the outsert is fully secured to the adhesive on the web by the pressure that is achieved from the spring in the side guide. The infeed side guide does not have to be spring loaded because it is cut out in the middle for the width of the web.

Figure 4:
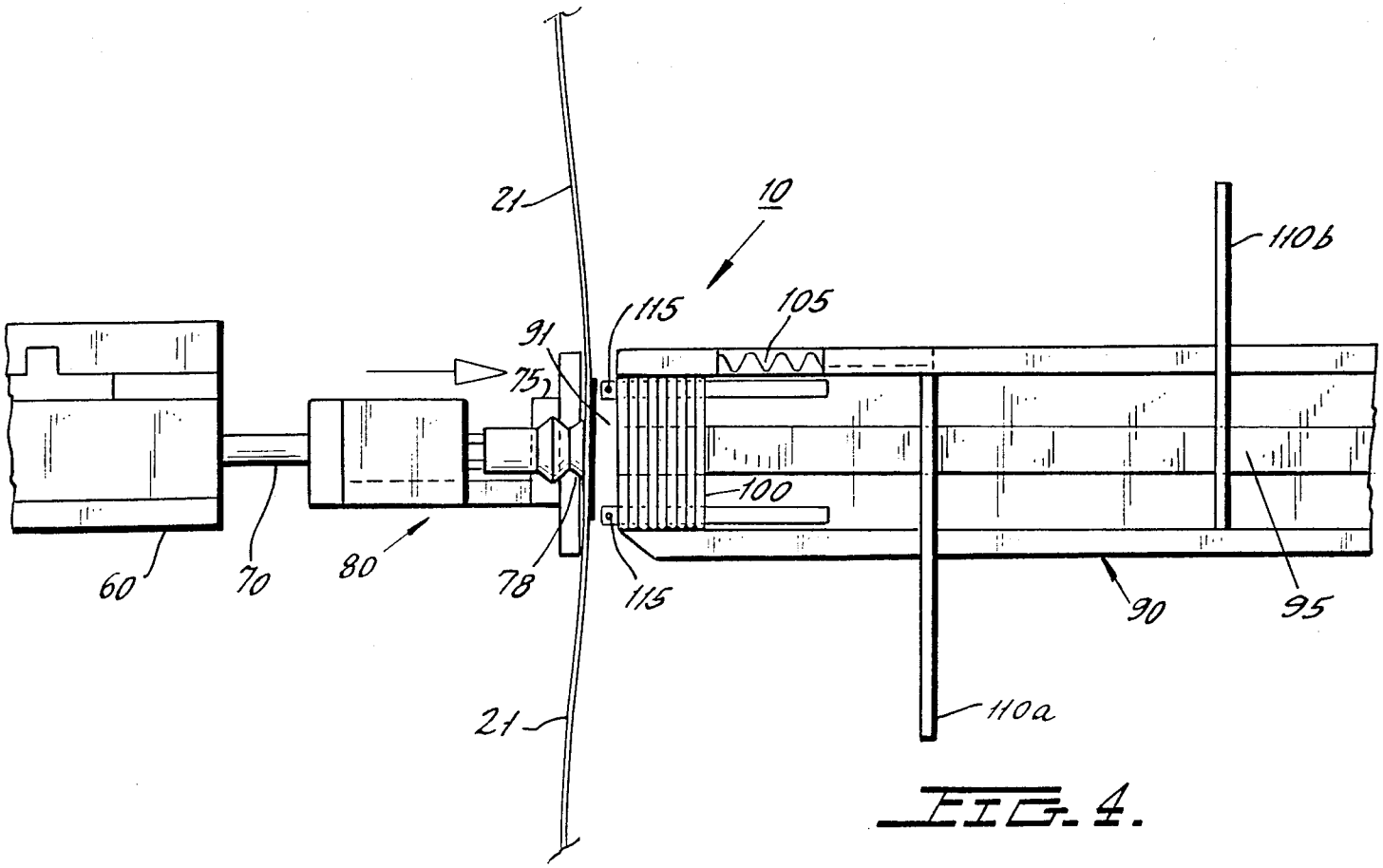
Figure 5:
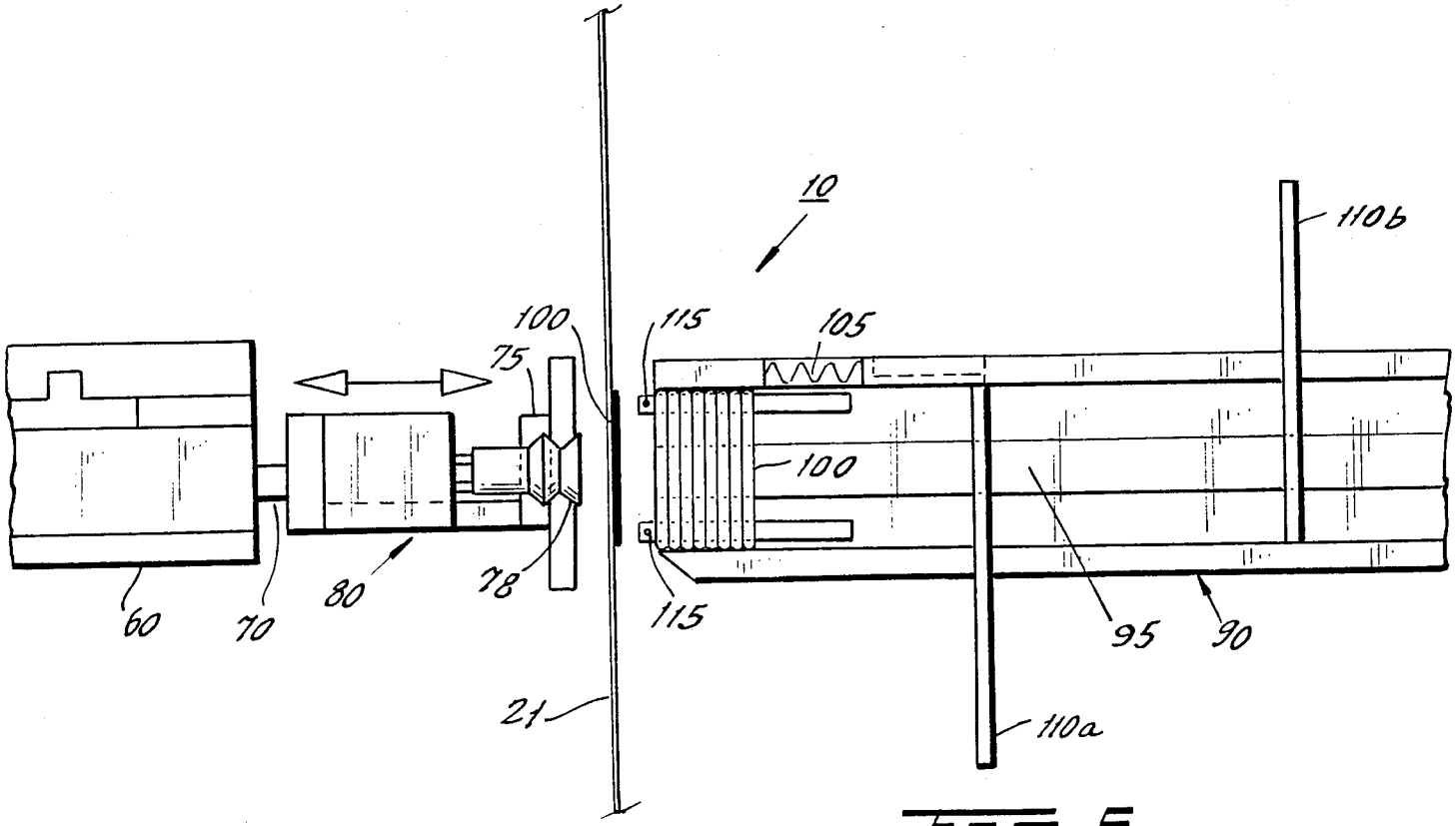
Figure 6:
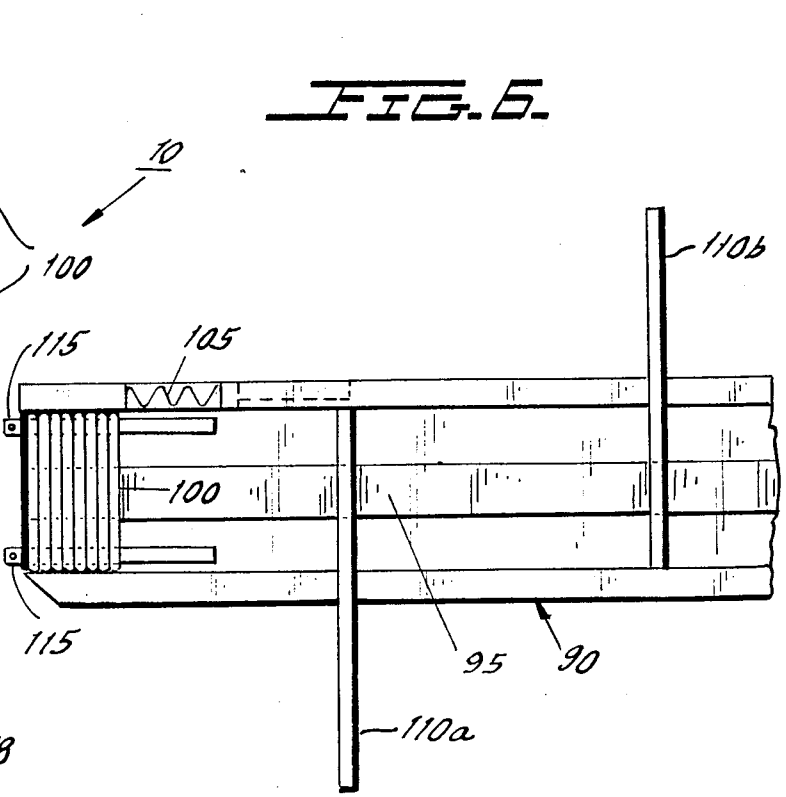
Figure 7:
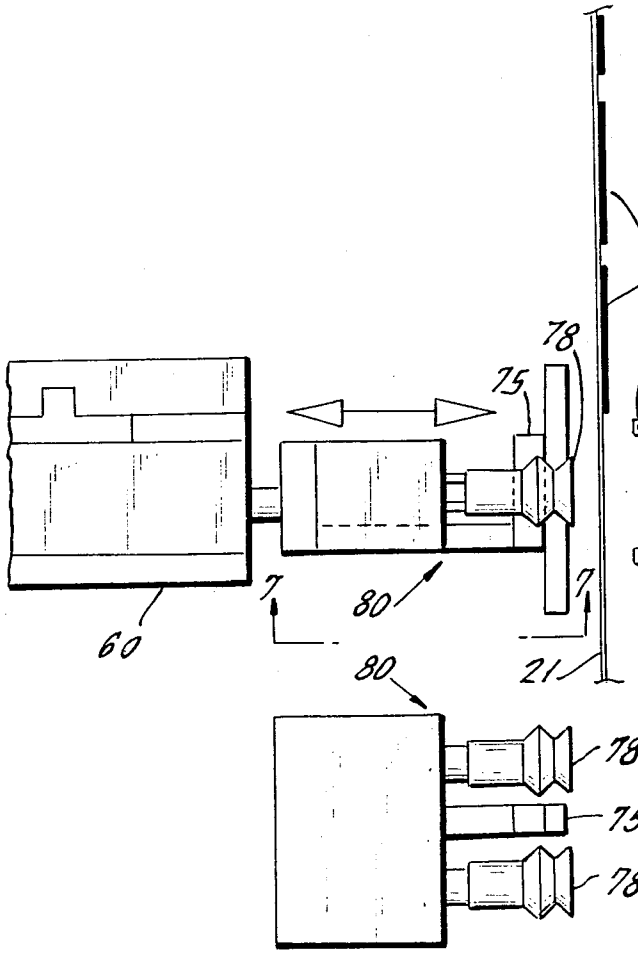
FIG. 7 is a side view of the bumper arrangement of the present invention.

As shown in the side view of FIG. 7, assembly 80 is provided with vacuum cups 78 above and below bumper 75 (only the upper cup is shown in the top view of FIGS. 2–6) which grip an outsert located in outlet 91 of hopper 90, and remove the outsert from the hopper as assembly 80 retracts (see FIG. 4). When assembly 80 is fully retracted as shown in FIG. 5, the vacuum mechanism is cut off. The outsert is now removed from hopper 90 affixed on web 21 by the adhesive.

FIGS. 2–6 show one complete cycle, where an outsert is removed from outlet 91 of hopper 90 and adhesively affixed to adhesive tape web 21. This cycle is repeated for the remaining outserts in hopper 90. As the cycle is repeated, adhesive web 21 is incrementally advanced by the drive mechanism, which is actuated and braked in accordance with signals from sensor 180 as discussed above.

Referring back now to FIG. 1, the outserts removed from hopper 90 are transported around a roller 120 to a peel plate roller 130 located in close proximity to containers 140 traveling to the right along container conveyer belt 190. As web 21 is drawn around roller peel plate 130, the outserts are peeled away and affixed to containers 140, as shown in FIG. 1. The adhesive web tape 21 then proceeds around peel roller 130, around the drive roller 160 and to the take-up roller 165.

Before adhesive web 21 is taken up by the rewind it is passed through a roller bight 150. Roller bight 150 is a spring-loaded mechanism having first and second rollers **150*a* and 150*b*. Roller 150*a* removes excess adhesive remaining on web 21 and thereby prevents the build-up of adhesive on drive roller 160 which is a common cause of web breaks in prior art systems. Roller bight 150 is spring-loaded, and as adhesive builds up in the roller bight, roller 150*a* springs outward as shown by the arrow in FIG. 1. Thus, the present invention prevents buildup of adhesive on the drive roller 160**, avoiding web breakage and mess at this roller.

Hopper 90 is a micro-adjustable carriage which is used to control accurate positioning of the outsert at the edge of roller peel plate 130. In the preferred embodiment of the invention, hopper 90 is 4 feet long and adjustable for various outsert widths. Hopper 90 is provided with pushers **110*a* and 110*b* which are used to maintain a constant force on the outserts. Each pusher uses approximately one pound constant force spring cable return to apply consistent pressure as hopper 90 runs empty. Nonstop continuous running is achieved by pulling back a pusher and loading the hopper manually while the other pusher is keeping the outserts in front of it running toward the hopper outlet. The hopper 90 also preferably has a driven belt 95 running the entire length of it. The belt is kept constantly running at a speed that will keep the outserts 100 agitated and advancing fast enough to insure that the next outsert to be removed is always at the correct position. A vibrator may be used instead of a belt, but this creates excessive noise. When a pusher approaches within a few inches of adhesive tape web 21, it automatically kicks out so that an operator can pull it back and reload hopper 90**.

In accordance with the present invention, the whole system is mounted on a plate and may be utilized to convert a standard labeling machine head into an improved outsert applying system. Thus, the present invention provides an improved method and apparatus for applying outserts to containers or an apparatus to convert a standard labeling machine head into an outsert applying system.

Although the present invention has been described in connection with a preferred embodiment thereof, many other variations and modifications will now become apparent to those skilled in the art without departing from the scope of the invention. It is preferred, therefore, that the present invention not be limited by the specific disclosure herein, but only by the appended claims.

What is claimed is:

1. An apparatus for applying outserts to articles, comprising:

means for supplying web having an adhesive on one surface and transporting said web to an outsert supplying mechanism;

means for bumping the adhesive, coated surface of said web into contact with an outsert located within said outsert supplying mechanism and transferring said outsert from within said outsert supplying mechanism onto said web;

means for transporting said web with said outsert to a position in proximity with said articles; and means for transferring said outsert from said web to one of said articles;

2. An apparatus as recited in claim 1, further comprising means for applying a vacuum to assist in removing said outsert from said outsert supplying mechanism.

3. An apparatus as recited in claim 1, wherein said outsert supplying mechanism comprises a hopper, said hopper having a spring loaded side guide and at least one pusher for maintaining substantially constant force upon said outserts.

4. An apparatus as recited in claim 3, wherein said hopper has a moving belt which is kept running at a speed that will keep said outserts agitated and advancing fast enough to insure that the next outsert to be removed from said hopper is in correct position to be attached to said web by said bumping means.

5. An apparatus as recited in claim 1, wherein said means for transferring said outsert from said web to one of said articles comprises a roller peel plate for peeling said outsert from said web and placing said outsert on said article.

6. An apparatus as recited in claim 2, wherein said means for bumping and said means for applying a vacuum to said outsert are mounted on an air-actuated cylinder.

7. An apparatus as recited in claim 6, wherein said means for supplying and transporting a web further comprises a counter spinning roller which said web passes around after passing around an idler roller, said counter spinning roller spinning in the opposite direction of web travel and having apertures through which vacuum is applied for maintaining a constant tension on said web.

8. An apparatus as recited in claim 7, wherein said means for supplying and transporting a web further comprises a second vacuum manifold for further maintaining a constant tension on said web, said second vacuum manifold disposed between said idler roller and said outsert supplying mechanism.

9. An apparatus as recited in claim 1, further comprising a spring loaded roller bight for collecting excess adhesive present on said web, said spring loaded roller bight being disposed between said means for transferring said outsert from said web to one of said articles and said means for driving said web.

10. A method of applying outserts to articles, comprising the steps of:

supplying a web having adhesive on one side to a position in proximity to an outlet of a hopper containing said outserts;

bumping said web into contact with an outsert located within said outlet of said hopper;

removing said outsert from said hopper by applying a vacuum to said outsert, said outsert being adhered to said web by said adhesive;

transporting said outsert adhered to said web to a position in proximity with said articles; and transferring said outserts adhered to said web from said web to said articles.

11. A method as claimed in claim 10, further comprising the step of sensing movement of said articles along a conveyor to initiate movement of said web to transfer said outserts to said articles and to initiate braking of said web.

12. A method as recited in claim 10, further comprising the step of maintaining a substantially constant tension on said web.

13. A method as recited in claim 12, wherein said substantially constant tension is maintained by applying vacuum to the surface of said web without adhesive as said web passes over a roller and across a manifold.

14. A method as recited in claim 10, further comprising the step of removing excess adhesive from said web after said outsert has been transferred to said article and before take up of said web.

15. A method as recited in claim 14, wherein said excess adhesive is removed by passing said web through a spring loaded roller bight.

* * * * *